US006360455B1

(12) United States Patent
Seo

(10) Patent No.: US 6,360,455 B1
(45) Date of Patent: Mar. 26, 2002

(54) PACK BOOT WITH RETRACTABLE CRAMPONS

(75) Inventor: Sang Rok Seo, Pusan (KR)

(73) Assignee: Rocky Shoes & Boots, Inc.

( * ) Notice: Subject to any disclaimer, the term of this patent is extended or adjusted under 35 U.S.C. 154(b) by 0 days.

(21) Appl. No.: 09/569,643

(22) Filed: May 12, 2000

(51) Int. Cl.[7] ..... A43C 15/00
(52) U.S. Cl. ..... 36/61; 36/134; 36/59 R
(58) Field of Search ..... 36/61, 62, 134, 36/59 R, 64–65

(56) References Cited

U.S. PATENT DOCUMENTS

| | | | | | |
|---|---|---|---|---|---|
| 139,506 | A | * | 6/1873 | Heulings | 36/61 |
| 259,311 | A | * | 6/1882 | Horowitz | 36/61 |
| 286,240 | A | * | 10/1883 | Treat | 36/61 |
| 3,716,931 | A | * | 2/1973 | Loudermilk | 36/61 |
| 4,375,729 | A | * | 3/1983 | Buchanen, III | 36/61 |
| 5,269,080 | A | | 12/1993 | Davis | |
| 5,299,369 | A | | 4/1994 | Goldman | |
| 5,337,494 | A | | 8/1994 | Ricker | |
| 5,497,565 | A | | 3/1996 | Balgin | |
| 5,557,865 | A | | 9/1996 | Sjosvard | |
| D401,746 | S | | 12/1998 | Brooks et al. | |
| 5,870,838 | A | | 2/1999 | Khavat | |

* cited by examiner

*Primary Examiner*—Paul T. Sewell
*Assistant Examiner*—Jila M. Mohandesi
(74) *Attorney, Agent, or Firm*—Porter, Wright, Morris & Arthur

(57) ABSTRACT

A pack boot includes an outsole and a pair of traction devices located on opposite ends of the outsole. The traction devices are substantially the same except oriented in opposite directions. Each traction device includes a generally planar base at a lower side of the outsole and secured to the outsole, a substantially planar anchor plate at an upper side of the outsole, a plurality of rivets extending from the base to the anchor plate and clamping the base to the anchor plate with the outsole therebetween, and a carrier having a pair of crampons and pivotally secured to the base between an active position wherein the crampons are downwardly facing and an inactive position wherein the crampons are upwardly facing. The carrier pivots about a horizontal, transverse pivot axis located at one end so that the carrier "turns over" as it pivots about 180 degrees between the active and inactive positions. The carrier has a generally planar main portion and the crampons are generally perpendicular thereto. Each crampon is generally planar and unitary with the carrier and oblique to and symmetrical about a central longitudinal axis of the base. Each crampon preferably has at least two teeth.

19 Claims, 4 Drawing Sheets

PACK BOOT WITH RETRACTABLE CRAMPONS

BACKGROUND OF THE INVENTION

The present invention generally relates to a footwear and, more particularly, to footwear having soles with a traction device which selectively makes the footwear non-slippery when required.

It is well known to provide crampons, cleats, spikes or the like on the bottom of footwear such as a shoe or boot to provide gripping and traction. The crampons are typically made of metal and downwardly extend from the bottom of the footwear sole to provide gripping or traction. While such crampons are very effective at providing traction under slippery conditions such as ice, they are undesirable under other conditions such as on hard surfaces like asphalt or concrete. Many solutions to this problem have been proposed which provide various constructions which move the cleats between an inactive or retracted position and an active or extended position. These prior constructions may adequately perform when applied to shoes for sporting events such as, for example, golf, baseball, and track and field, but they have inadequate strength to be applied to shoes or boots for outdoor activities such as, for example, backpacking, hiking, and hunting. Due to this inadequate strength, the prior constructions have a tendency to frequently malfunction or fail. Also, many of these prior art constructions are difficult and time consuming to manipulate when moving the crampons between the active and inactive positions.

Accordingly, there is a need in the art for improved footwear with a traction device which is movable between active and inactive positions that has sufficient strength for use in heavy duty applications without frequent failure, that is reliable, that is relatively inexpensive to produce, and/or that is easily and quickly manipulated between the active and inactive positions.

SUMMARY OF THE INVENTION

The present invention provides footwear which overcomes at least some of the above-noted problems of the related art. According to the present invention, footwear includes an outsole and at least one traction device. The traction device includes a base at a lower side of the outsole and secured to the outsole, and a carrier having at least one crampon and pivotally secured to the base between an active position wherein the crampon is downwardly facing and an inactive position wherein the crampon is upwardly facing. In a preferred embodiment, the carrier pivots about 180 degrees between the active and inactive positions.

According to another aspect of the present invention, footwear includes an outsole and at least one traction device. The traction device includes a base at a lower side of the outsole and secured to the outsole, an anchor plate at an upper side of the outsole, a plurality of fasteners extending from the base to the anchor plate and clamping the base to the anchor plate with the outsole therebetween, and a carrier having at least one crampon and pivotally secured to the base between an active position and an inactive position. In a preferred embodiment, the anchor plate is substantially planar and the base is generally planar and the fasteners are rivets.

According to yet another aspect of the present invention, a boot includes an outsole, and at least one traction device. The traction device includes a generally planar base at a lower side of the outsole and secured to the outsole, a substantially planar anchor plate at an upper side of the outsole, a plurality of fasteners extending from the base to the anchor plate and clamping the base to the anchor plate with the outsole therebetween, and a carrier having at least one crampon and pivotally secured to the base between an active position wherein the crampon is downwardly facing and an inactive position wherein the crampon is upwardly facing. The carrier has a generally planar main portion and the crampon is generally perpendicular thereto. In a preferred embodiment, the crampon is generally planar and unitary with the carrier.

From the foregoing disclosure and the following more detailed description of various preferred embodiments it will be apparent to those skilled in the art that the present invention provides a significant advance in the technology and art of footwear. Particularly significant in this regard is the potential the invention affords for providing an easy-to-use, high quality, high strength, reliable, low cost traction device for footwear such as pack boots. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
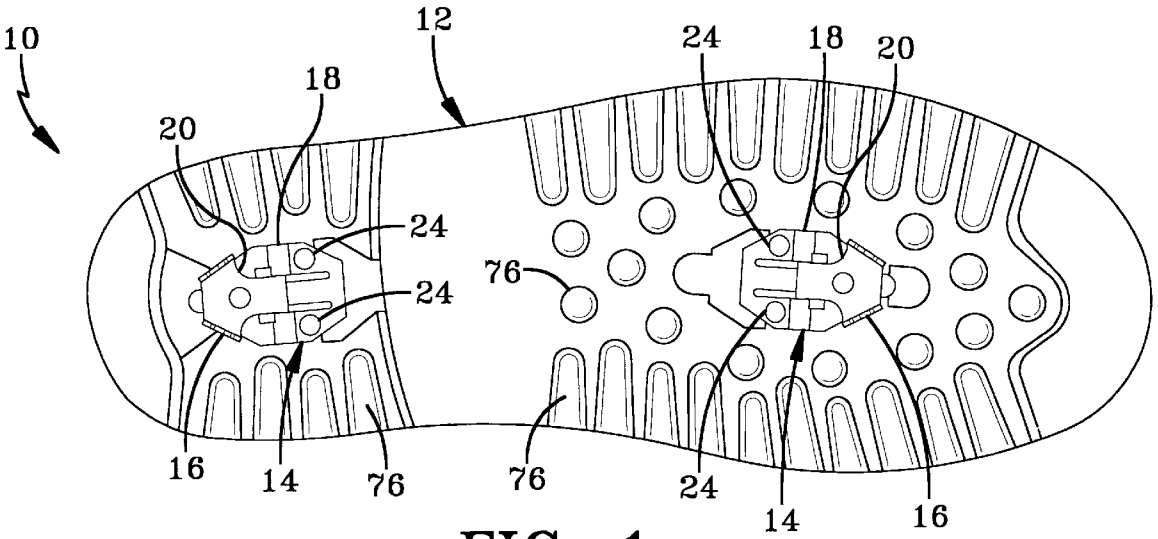
FIG. 1 is bottom plan view of a sole of a pack boot having a pair of traction devices according to a preferred embodiment of the present invention with each of the traction devices in an active or extended position.

It should be understood that the appended drawings are not necessarily to scale, presenting a somewhat simplified representation of various preferred features illustrative of the basic principles of the present invention. The specific design features of footwear as disclosed herein, including, for example, specific shapes of the crampons will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the footwear illustrated in the drawings. In general, up or upward refers to an upward direction in the plane of the paper in FIGS. 2 and down or downward refers to a downward direction in the plane of the paper in FIGS. 2. In general, front or forward refers to right direction in the plane of the paper in FIGS. 1 and 2 and rear or rearward refers to a left direction in the plane of the paper in FIGS. 1 and 2.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved footwear disclosed herein. The following detailed discussion of various alternative and preferred embodiments will illustrate the general principles of the invention with reference to an improved pack boot. Other embodiments suitable for other applications will be apparent to those skilled in the art given the benefit of this disclosure. The term "crampon" is used herein and in the claims to mean a member designed to be attached to the bottom of a shoe to prevent slipping when climbing or walking such as a cleat, a spike, or the like.

Referring now to the drawings, FIGS. 1 to 7 illustrate a sole 10 of a pack boot according to a preferred embodiment of the present invention. Further components of the pack boot are conventional and therefore are not described in detail. See, for example, U.S. Pat. No. Des. 368,361 showing a suitable pack boot, the disclosure of which is expressly incorporated herein in its entirety. The sole 10 includes an outsole 12 and a pair of anti-skid or traction devices 14 secured to the outsole 12. Each of the traction devices 14 are movable between an active or extended position wherein at least one crampon 16 extends below the outsole 12 and an inactive or retracted position wherein the crampon 16 is entirely above the bottom of the outsole 12. A first one of the traction devices 14 is located near the rearward end or heel of the sole 10 and a second one of the traction devices 14 is located is located near a forward end of the sole 10. While the illustrated sole 10 includes two of the traction devices 14, it is noted that the sole 10 can have one or more of the traction devices 14 within the scope of the present invention. The first and second traction devices 14 of the present invention are substantially identical other than location and orientation, therefore, only the first traction device 14 will be described in detail hereinafter.

Figure 8:
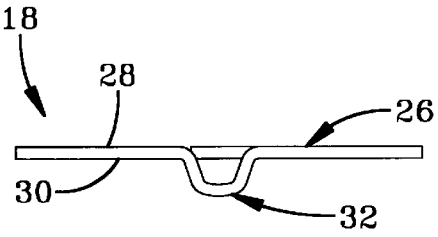
FIG. 8 is a side elevational view of a base plate of the traction device of FIGS. 1 to 7.
Figure 9:
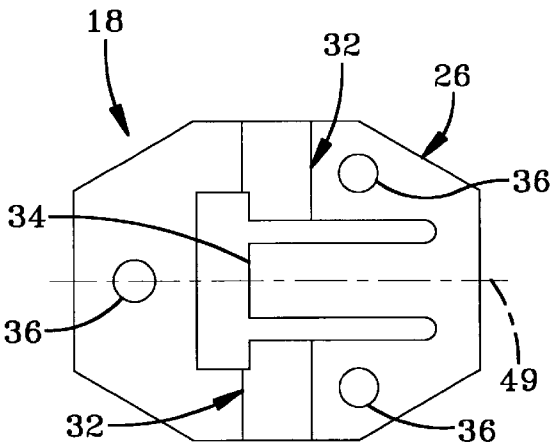
FIG. 9 is a bottom plan view of the base plate of FIG. 8.

Each traction device 14 includes a base 18 located at the bottom of the outsole 12, a carrier 20 pivotably secured to the base 18 and carrying at least one crampon, cleat, spike, or the like 16, an anchor or bearing plate 22 located at the top of the outsole 12, and fasteners 24 securing the base 18 to the anchor plate 22. As best shown in FIGS. 8 and 9, the illustrated base 18 is generally planar or flat having a substantially planar or flat main portion 26 in the form of a plate or sheet having substantially parallel and planar upper and lower surfaces 28, 30. Centrally formed in the main portion 26 of the base 18 are a pair of transversely extending channels portions 32. The channel portions 32 are aligned and spaced apart on opposite transverse sides of the main portion 26 . The illustrated channel portions 32 downwardly extend from the main portion 26 and are open at the upper surface 28 of the main portion 26. The channel portions 32 are sized and shaped to form hubs which cooperate with the pivotable carrier 20 as described in more detail hereinafter. Formed in the main portion 26 between the channel portions 32 is a spring member 34. The illustrated spring member 34 is in the form of a longitudinally extending leaf spring or cantilevered tab which has a free end located generally between the channel portions 32. It is noted that the spring member 34 can have may alternative forms within the scope of the present invention The illustrated spring member 34 is substantially planar or flat and is co-planar with the main portion 26 at the top opening of the channel portions 32. The spring member 34 is sized and shaped to cooperate with the carrier 20 to bias the carrier 20 in either direction as described in more detail hereinafter. Also formed in the main portion 26 is a plurality of apertures or openings 36 which are sized and located for cooperation with the outsole 12, the anchor plate 22, and the fasteners 24. The illustrated base 18 is provided with three openings 36 but it is noted that a greater or lesser number of openings 36 can be utilized. The base 18 is preferably formed of a rigid metal such as, for example, a corrosion resistant steel. The base 18 is also preferably unitary, that is, formed from a single plate or sheet of material.

Figure 10:
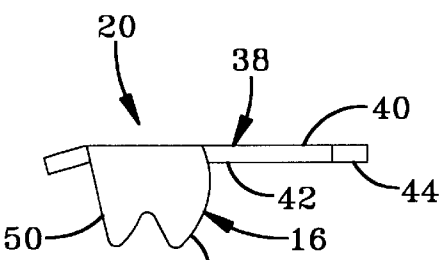
FIG. 10 is a side elevational view of a crampon of the traction device of FIGS. 1 to 7.
Figure 11:
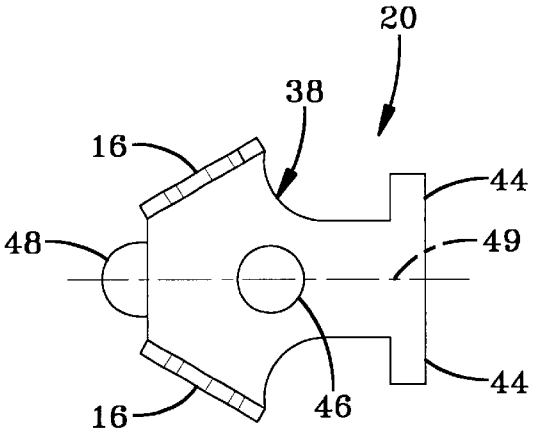
FIG. 11 is a bottom plan view of the crampon of FIG. 10.

As best shown in FIGS. 10 and 11, the illustrated carrier 20 is generally planar or flat having a substantially planar or flat main portion 38 in the form of a plate or sheet. The main portion 38 has substantially planar and parallel upper and lower surfaces 40, 42. Formed at one end of main portion 38 is a pair of transversely extending tab portions 44. The tab portions 44 are aligned and extend outwardly from opposite transverse sides of the main portion 38. The illustrated tab portions 44 are co-planar with the main portion 38. The tab portions 44 are sized and shaped to form axles and to extend into the hubs of the base 18 such that the carrier 20 is pivotable relative to the base 18 as described in more detail hereinafter. Formed in the main portion 38 is a clearance opening 46 sized and shaped for passage of a portion of one of the fasteners 24, such as a rivet head, therethrough (best shown in FIG. 4). The illustrated carrier 20 is also provided with a handle 48 at an end opposite the tab portions 44. The illustrated handle 48 is in the form of a downwardly bent tab extending from an end of the main portion 38.

Secured to the carrier 20 at an end opposite the tab portions 44 are a pair of the crampons 16. It is noted that a greater or lesser number of the crampons 16 can be secured to the main portion 38. The illustrated crampons 16 are generally planar and perpendicularly extend from an edge of the main portion 38 but the crampons 16 can have many other forms within the scope of the present invention. The illustrated crampons 16 are oblique to and symmetrical about a central longitudinal axis 49 and are directed inwardly in a direction opposite the tab portions 44. The illustrated crampons 16 each have first and second teeth 50, 52 but the crampons 16 can have many different forms within the scope of the present invention. The carrier 20 is preferably formed of a rigid metal such as, for example, a corrosion resistant steel. The carrier 20 is preferably unitary, that is, formed from a single sheet of material. It is noted, however, that the crampons 16 can be alternatively formed separate from the main portion 38 and rigidly attached to the main portion 38.

Figure 12:
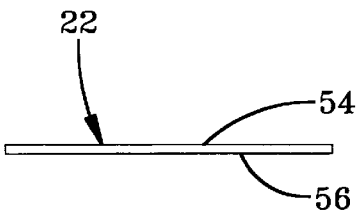
FIG. 12 is a side elevational view of an anchor plate of the traction device of FIGS. 3 to 7.
Figure 13:
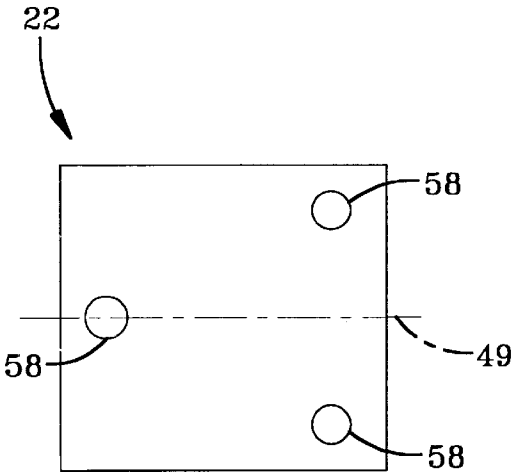
FIG. 13 is a bottom plan view of the anchor plate of FIG. 12.

As best shown in FIGS. 12 and 13, the illustrated ah 2 is substantially planar or flat in the form of a sheet or plate and has substantially planar and parallel upper and lower surfaces 54, 56. Formed in the anchor plate 22 is a plurality of apertures or openings 58 which are sized and located for cooperation with the outsole 12, the openings 36 of the base 18, and the fasteners 24. The illustrated anchor plate 22 is provided with three openings 58 but it is noted that a greater or lesser number of openings 58 can be utilized. The anchor plate 22 is preferably formed of a rigid metal such as, for example, a corrosion resistant steel.

Figure 14:
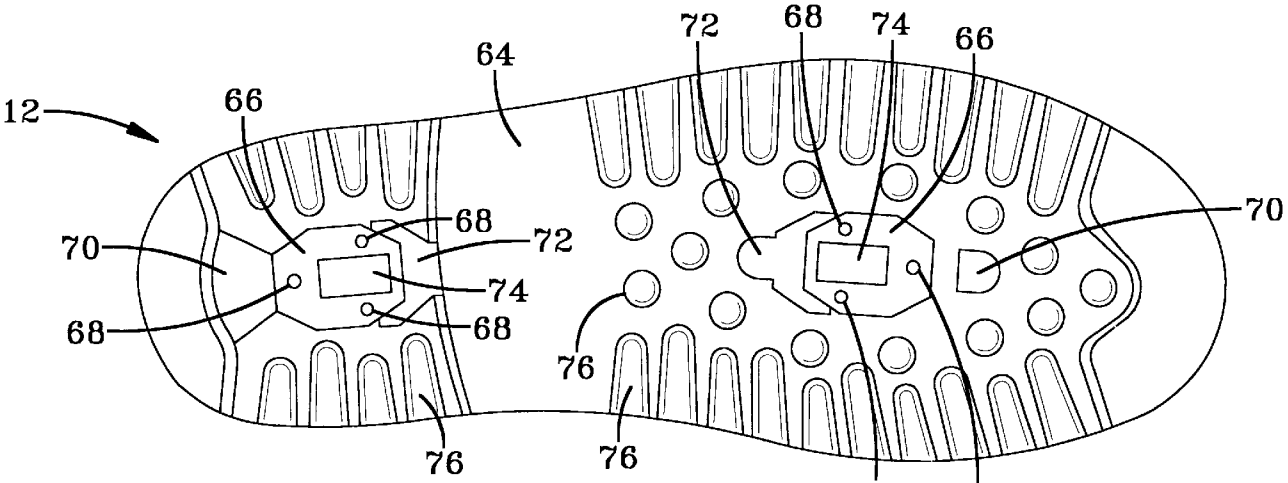
FIG. 14 is a bottom plan view of a rubber outsole of the sole of FIGS. 1 to 7.
Figure 15:
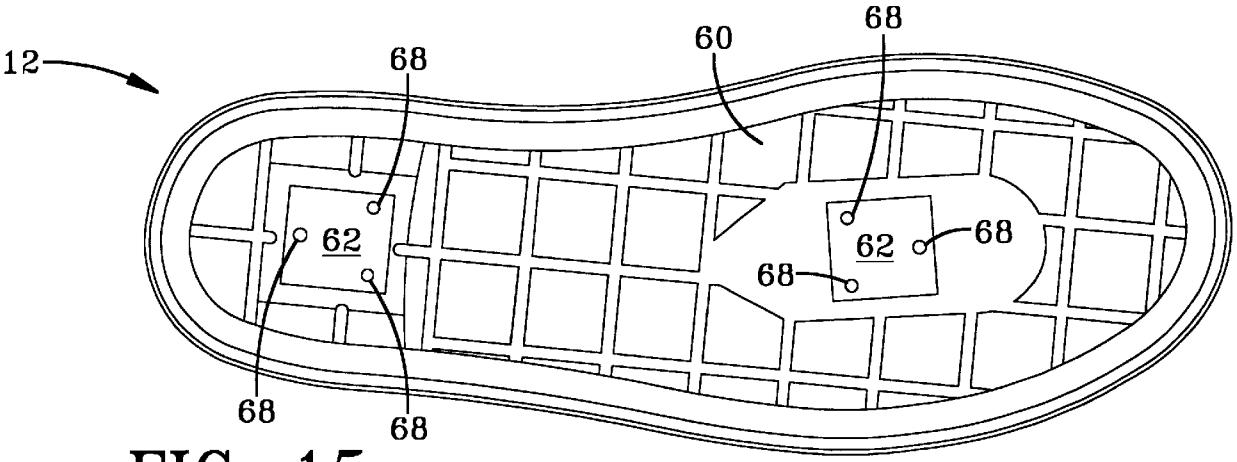
FIG. 15 is a top plan view of the rubber outsole of FIG. 14.

As best shown in FIGS. 14 and 15, the illustrated outsole 12 is preferably constructed in a known manner except that it is adapted for connection of the pair of traction devices 14 thereto. Because these adaptations are identical for each of the traction devices 14 except for location and orientation, only the adaptations for the first traction device 14 will be described in detail hereinafter. The upper surface 60 of the outsole 12 is provided with an anchor plate recess 62 which is sized and shaped for closely receiving the anchor plate 22 therein. The depth of the anchor plate recess 62 is preferably sized to receive both the anchor plate 22 and heads of the fasteners 24 therein such that they are all below the upper surface 60 of the outsole 12. The lower surface 64 of the outsole 12 is preferably provided with a base recess 66 which is sized and shaped for receiving the base 18 therein. The base recess 66 is located directly below the anchor plate recess 62. The depth of the base recess 66 is preferably generally equal to or less than the thickness of the main portion 26 of the base 18. A plurality of apertures or openings 68 are provided which are sized and located for cooperation with the openings 36 of the base 18, and the openings 58 of the anchor plate 22, and the fasteners 24. The illustrated outsole 12 is provided with three openings 68 but it is noted that a greater or lesser number of openings 68 can be utilized. The openings 68 vertically extend through the outsole 12 from the base recess 66 to the anchor plate recess 62. Located at one end of the base recess 66 is a handle recess 70 which is sized and shaped such that the handle 48 of the carrier 20 can be easily grasped by the user when the carrier 20 is in the active position as described in more detail hereinafter. It is noted that the handle recess 70 has a greater depth than the base recess 66. Located at the other end of the base recess 66, opposite the handle recess 70, is a crampon recess or cavity 72 which is sized and shaped to receive the crampons 16 of the carrier 20 when the carrier 20 is in the inactive position as described in more detail hereinafter. It is noted that the crampon recess 72 has a much greater depth than the base recess 62 or the handle recess 70. The illustrated crampon recess 72 is generally U-shaped such that it partially extends along the lateral sides of the base recess 66. Located within the base recess 66, is a spring member recess 74 which is sized and shaped to permit resilient downward flexing of the spring member 34 by the end of the carrier 20 when the carrier 20 pivots as described in more detail hereinafter.

The lower surface 64 of the outsole 12 is provided with a plurality of protrusions 76 which generally surround the base recesses 66 along the periphery of the outsole 12. The protrusions 76 can be sized and shaped in any suitable manner. The protrusions 76 define bottom planes of the outsole 12 which engage the ground when the footwear is worn by the user. The outsole 12 is preferably formed of a suitable flexible material such as, for example, a rubber.

Figure 4:
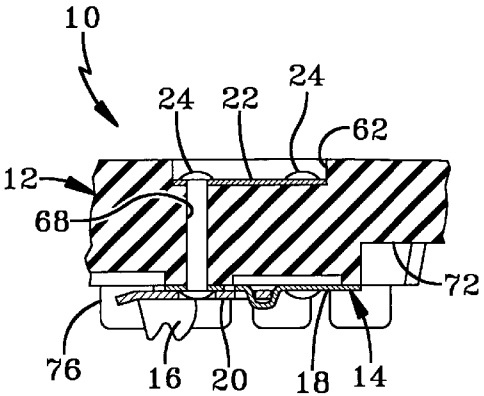
FIG. 4 is a cross-sectional view, taken along line 4—4 of FIG. 3.
Figure 3:
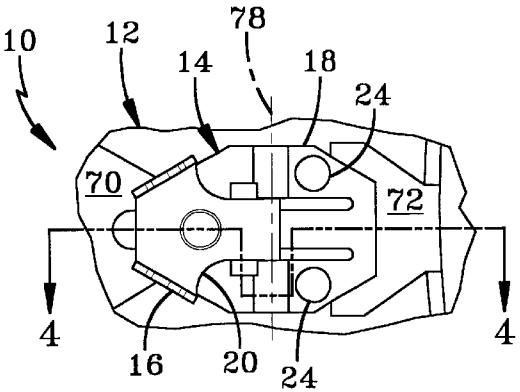
FIG. 3 is an enlarged, fragmented bottom plan view showing a portion of the sole of FIG. 1.

As best shown in FIGS. 3 and 4, the carrier 20 is attached to the base 18 such that the tab portions 44 of the carrier 20 are located within the channel portions 32 of the base 18. With the tab portions 44 located in the channel portions 32, the carrier 20 is pivotable about a horizontal, transverse pivot axis 78, defined by the tab portions 44 and the channel portions 32 ,from the active position to the inactive position. Mounted in this manner, the carrier 20 pivots about one end so that the carrier 20 is "turned over" as it pivots between the active and inactive positions. The carrier 20 preferably pivots about 135 degrees to about 225 degrees between the active position and the inactive position and more preferably pivots about 180 degrees between the active position and the inactive position. The base 18 is positioned in the base recess 66 with the upper surface 28 of the main portion 26 engaging the bottom of the base recess 62, that is, the lower surface 64 of the outsole 12. The anchor plate 22 is positioned in the anchor plate recess 62 with the lower surface 56 of the anchor plate 22 engaging the bottom of the anchor plate recess 62, that is, the upper surface 60 of the outsole 12. The fasteners 24 extend through the openings 36, 68, 58 in the base 18, the outsole 12 and the anchor plate 22 respectively to clamp the base 18 and the anchor plate 22 together with the outsole 12 located therebetween. The illustrated fasteners 24 are rivets, but it is noted that other suitable fasteners can be utilized within the scope of the present invention. Secured in this manner, the base 18 and the anchor plate 22 effectively transfer loads applied to the crampons 16 to a suitably large area of the outsole 12.

Figure 2:
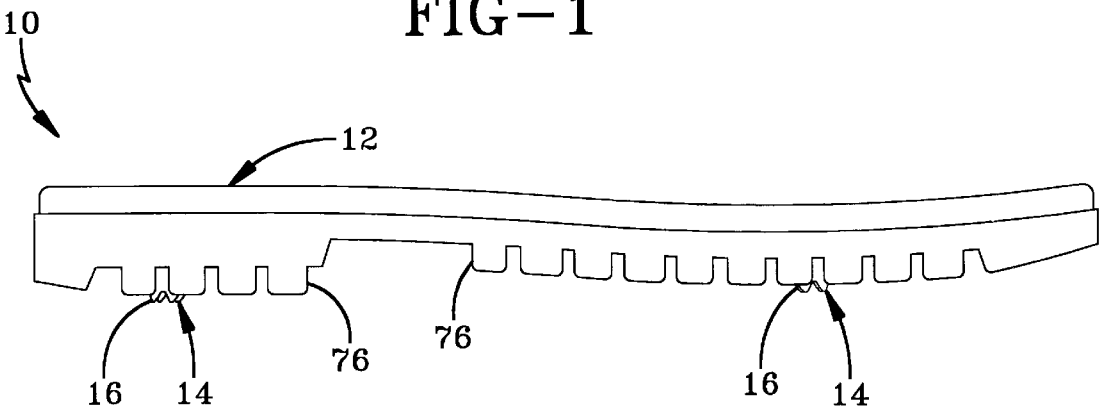
FIG. 2 is a side elevational view of the sole of FIG. 1.

As best shown in FIG. 1, the first one of traction devices 14 is located near the rearward end or heel of the sole 10 and a second one of the traction devices 14 is located is located near a forward end of the sole 10. In the illustrated embodiment, the traction devices 14 are oriented in opposite directions such that the carriers 20 each pivot toward the center of the sole 10 when pivoting from the active to the inactive position. As best shown in FIGS. 2 and 4, when the crampons 16 position, the crampons 16 face downward and extend below the bottom plane formed by the surrounding outsole protrusions 76. In this active position, the planar upper surface 40 of the carrier main portion 38 engages the planar lower surface 30 of the base main portion 26 so that loads applied to the carrier 20 are transferred over a substantially large area. With the crampons 16 downwardly extending below the outsole protrusions 76, the crampons 16 engage the surface supporting the footwear's user to provide additional traction.

Figure 5:
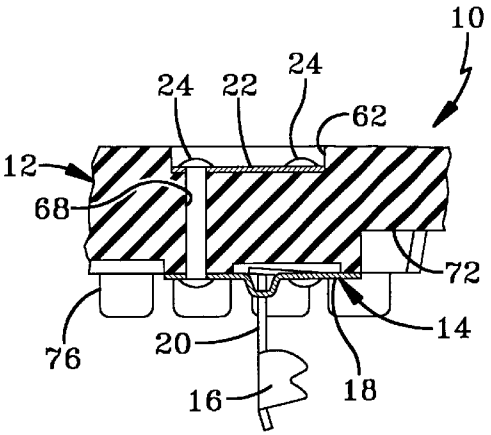
FIG. 5 is a cross-sectional view similar to FIG. 4 but showing the traction device in an intermediary or transitional position.

When it is desired to move the carrier 20 to the inactive position, the user grasps the handle 48 and manually pivots the carrier 20 about 180 degrees. It is noted that the user must manually pivot each of the carriers 20 separately so that if desired, the carriers 20 can be in opposite positions. As best shown in FIG. 5, the end of the carrier 20 deflects the spring member 34 as the carrier 20 pivots. The spring member 34 biases the carrier 20 in both directions so that the spring member 34 both assists in moving the carrier 20 over the final portion of travel and also maintains the carrier 20 in the desired one of the active and inactive positions. Accordingly, a single spring member 34 biases the carrier 20 into each of the active and inactive positions.

Figure 7:
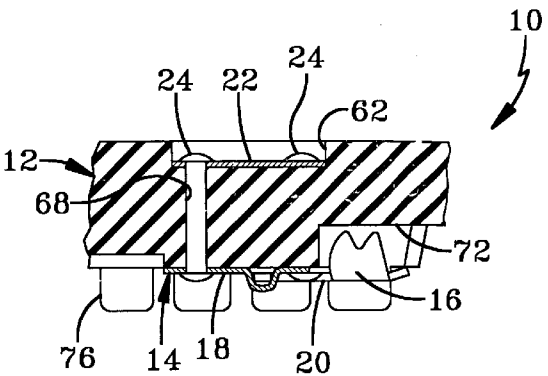
FIG. 7 is a cross-sectional view, taken along line 7—7 of FIG. 6.
Figure 6:
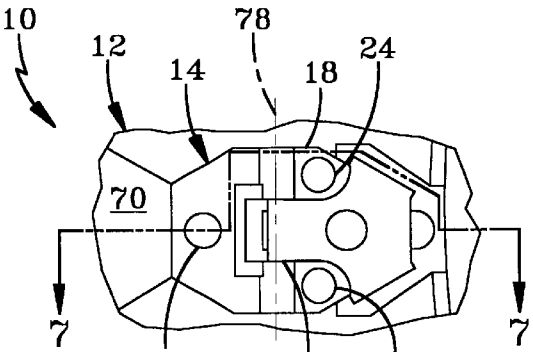
FIG. 6 is an enlarged, fragmented bottom plan view similar to FIG. 3 but showing the traction device in an inactive or retracted position.

As best shown in FIGS. 6 and 7, when the carrier 20 has been pivoted about 180 degrees and the crampons 16 are in the inactive position, the crampons 16 face upward and extend into the crampon cavity 72 so that no portion of the traction device 14 extends below the plane formed by the surrounding outsole protrusions 76. In this inactive position, the planar lower surface 42 of the carrier main portion 38 engages the planar lower surface 30 of the base main portion 26. With no portion of the traction device 14 downwardly extending below the outsole protrusions 76, the traction device 14 does not engage the surface supporting of the footwear's user and has no effect thereon. To return the crampons 16 to the active position, the user simply grasps the handle 48 and pivots the carrier 20 in the opposite direction.

It is apparent that the present invention provides footwear with a traction device 14 which is movable between active and inactive positions that has sufficient strength for use in heavy duty applications such as pack boots for outdoor sporting activities without frequent failure, that is reliable, that is relatively inexpensive to produce, and that is easily and quickly manipulated between the active and inactive positions.

From the foregoing disclosure and detailed description of certain preferred embodiments, it will be apparent that various modifications, additions and other alternative embodiments are possible without departing from the true scope and spirit of the present invention. For example, it will be apparent to those skilled in the art, given the benefit of the present disclosure, that the carriers 20 and/or the crampons 16 can have many different forms. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. Footwear comprising:

an outsole;

at least one traction device including a base at a lower side of the outsole and secured to the outsole, and a carrier having at least one crampon and pivotally secured to said base between an active position wherein said crampon is downwardly facing and an inactive position wherein said crampon is upwardly facing, wherein said at least one traction device further includes an anchor plate at an upper side of said outsole and a plurality of fasteners extending from said base to said anchor plate and clamping said base to said anchor plate with said outsole therebetween; and wherein said base and said anchor plate are on opposite sides of the outsole and are spaced apart by said outsole.

2. The footwear according to claim 1, wherein said carrier pivots from about 135 degrees to about 225 degrees between the active and inactive positions.

3. The footwear according to claim 2, wherein said carrier pivots about 180 degrees between the active and inactive positions.

4. The footwear according to claim 1, further comprising at least one spring member which biases said carrier into the active and the inactive positions.

5. The footwear according to claim 1, wherein a single spring member biases said carrier into both the active and the inactive positions.

6. The footwear according to claim 5, wherein said spring member is a leaf spring attached to the base.

7. The footwear according to claim 5, wherein said spring member is a leaf spring integral with the base.

8. The footwear according to claim 1, wherein said carrier has at least two of the crampons.

9. The footwear according to claim 8, wherein said at least two crampons are each oblique to and symmetrical about a central longitudinal axis of the base.

10. The footwear according to claim 1, wherein said carrier has a generally planar main portion and said crampon is generally perpendicular thereto.

11. The footwear according to claim 10, wherein said crampon is generally planar.

12. The footwear according to claim 11, wherein said crampon is unitary with said carrier.

13. The footwear according to claim 1, wherein said anchor plate is substantially planar and said base is generally planar and wherein said anchor plate is substantially parallel with said base.

14. The footwear according to claim 1, wherein said fasteners are rivets.

15. Footwear comprising:

an outsole; and at least one traction device including a base at a lower side of the outsole and secured to the outsole, an anchor plate at an upper side of said outsole, a plurality of fasteners extending from said base to said anchor plate and clamping said base to said anchor plate with said outsole therebetween, and a carrier having at least one crampon and pivotally secured to said base between an active position and an inactive position.

16. The footwear according to claim 15, wherein said anchor plate is substantially planar and said base is generally planar.

17. The footwear according to claim 15, wherein said fasteners are rivets.

18. A boot comprising:

an outsole; and at least one traction device including a generally planar base at a lower side of the outsole and secured to the outsole, a substantially planar anchor plate at an upper side of said outsole, a plurality of fasteners extending from said base to said anchor plate and clamping said base to said anchor plate with said outsole therebetween, and a carrier having at least one crampon and pivotally secured to said base between an active position wherein said crampon is downwardly facing and an inactive position wherein said crampon is upwardly facing, wherein said carrier has a generally planar main portion and said crampon is generally perpendicular thereto and wherein said base and said anchor plate arc substantially parallel and located on opposite sides of the outsole.

19. The boot according to claim 18, wherein said crampon is generally planar and unitary with said carrier.

* * * * *